US005533720A

United States Patent [19]

Ahl et al.

[11] Patent Number: 5,533,720

[45] Date of Patent: Jul. 9, 1996

[54] SHEET CONTROL BAFFLE FOR USE IN AN ELECTROPHOTOGRAPHIC PRINTING MACHINE

[75] Inventors: David K. Ahl, Rochester; Roger M. Swanson, Fairport; James D. Apolito; Walter F. Wafler, both of Rochester, all of N.Y.

[73] Assignee: Xerox Corporation, Stamford, Conn.

[21] Appl. No.: 268,142

[22] Filed: Jun. 29, 1994

[51] Int. Cl.[6] ..... B65H 5/00

[52] U.S. Cl. ..... 271/225; 271/184; 271/204; 271/277

[58] Field of Search ..... 271/277, 184, 271/225, 204–206, 82; 101/409

[56] References Cited

U.S. PATENT DOCUMENTS

| | | | |
|---|---|---|---|
| 3,278,179 | 10/1966 | Hartel | 271/82 |
| 3,918,707 | 11/1975 | Villemer et al. | 271/277 |
| 4,071,233 | 1/1978 | Morton | 271/184 |
| 4,739,362 | 4/1988 | Kau et al. | 355/3 TR |
| 4,823,158 | 4/1989 | Casey et al. | 355/3 TR |
| 4,994,864 | 2/1991 | Schleck et al. | 355/317 |
| 5,151,745 | 9/1992 | Durland et al. | 355/313 |

FOREIGN PATENT DOCUMENTS

| | | | |
|---|---|---|---|
| 1162982 | 9/1969 | United Kingdom | 271/82 |

OTHER PUBLICATIONS

Xerox 5775 Digital Color Copier Principles of Operation Manual, Sep. 1992, pp. 8–25 to 8–72.

*Primary Examiner*—H. Grant Skaggs

[57] ABSTRACT

An apparatus for advancing a sheet in a predetermined path is described. The apparatus includes a gripper for releasably grasping a lead edge of the sheet and a baffle for feeding the sheet into the gripper. The baffle includes a sheet directing member having a first facet and a second facet, with the second facet of the sheet directing member extending from the first facet and being angled towards the predetermined path of the sheet for deflecting the lead edge of the sheet being advanced into the gripper. One, two or more such two faceted sheet directing members may be coupled with one or more three faceted sheet directing members for further enhancing the sheet deflecting capabilities of the baffle. The baffle may be movable relative to the sheet path, and include a control member for moving the baffle between a first position engaging the lead edge of the sheet in the first position and second position in which the baffle is displaced from the path of the sheet.

15 Claims, 4 Drawing Sheets

SHEET CONTROL BAFFLE FOR USE IN AN ELECTROPHOTOGRAPHIC PRINTING MACHINE

This invention relates generally to an electrophotographic printing machine and, more particularly, concerns a sheet transport control baffle for use in an electrophotographic printing machine.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed in an imaging zone to a light source such as a raster output scanner. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. Generally, the developer material comprises toner particles adhering triboelectrically to carrier granules. The toner particles are attracted to the latent image from the carrier granules to form a toner image on the photoconductive member which is subsequently transferred to a copy sheet. The copy sheet is then heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray to a recirculating path internal the printing machine where a plurality of toner images are transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips the leading edge of the copy sheet and moves the sheet in a recirculating path so that accurate multi-pass color registration is achieved. In this way, magenta, cyan, yellow, and black toner images are transferred to the copy sheet in registration with one another.

Various systems which have been designed for transporting a copy sheet in a predetermined path have a number of devices which function to affect and control movement of the sheet while it is being advanced in its path within the printing machine. Examples of such sheet control devices include sheet grippers and sheet guides. Some of these sheet control devices are fixed at various stationary locations adjacent the path of movement of the sheet and consequently act on the sheet as the sheet is being transported adjacent each stationary sheet control device. Other such devices are moved in and out of an operative position by a solenoid or other force applying mechanism. Some systems have multiple sheet control devices which are moved in and out of an operative position, each being moved by a separate and distinct solenoid or other force applying mechanism. Various baffle systems may have difficulty in maneuvering the lead edge of various substrates into a sheet gripper, particularly when sheet stiffness or curl causes the sheet to resist insertion into a sheet gripper. The following disclosures may be relevant to various aspects of the present invention:

U.S. Pat. No. 5,151,745

Patentee: Durland et al.

Issued: Sep. 29, 1992

U.S. Pat. No. 4,994,864

Patentee: Schleck et al.

Issued: Feb. 19, 1991

U.S. Pat. No. 4,823,158

Patentee: Casey et al

Issued: Apr. 18, 1989

U.S. Pat. No. 4,739,362

Patentee: Kau et al.

Issued: Apr. 19, 1988

Xerox 5775 Digital Color Copier

Principles of Operation Manual

Sep. 1992, pp. 8–25 to 8–72

The relevant portions of the foregoing disclosures may be briefly summarized as follows:

U.S. Pat. No. 5,151,745 discloses an apparatus including a first mechanism for controlling movement of the sheet while it is being advanced in the path. The first controlling mechanism is in contact with the sheet in a first mode of operation and is spaced apart from the sheet in a second mode of operation. The apparatus also includes a second mechanism for controlling movement of the sheet while it is being advanced in the path, the second controlling mechanism being in contact with the sheet in a first mode of operation and being spaced apart from the sheet in a second mode of operation. The apparatus further includes an intermediate member movable between a first location and a second location, each of the controlling mechanisms being positioned in one of its respective modes of operation in response to the intermediate member being positioned at its first location and being positioned in the other of its respective modes of operation in response to the intermediate member being positioned at its second location.

U.S. Pat. No. 4,994,864 discloses a printing apparatus includes a copy sheet skew adjustment device. The copy sheet adjustment device is a pivotable baffle positioned between transfer and copy sheet registration stations of the printer and hinged at one end. At the other end, the baffle is connected to a screw and a nut such that when the nut is rotated it pivots the baffle further either into or out of the path of the copy sheets. This shortens or lengthens the distance the copy sheets have to travel to the transfer station and in doing so skews the copy sheets to the proper alignment.

U.S. Pat. No. 4,823,158 discloses a transfer means in an electrographic printing apparatus having a charge retaining member with a relatively high background potential of a first polarity, a transfer corotron having a relatively high potential of a second polarity and providing a transfer region for a transfer of toner to copy sheets, and a pretransfer baffle disposed adjacent to the transfer corotron, the pretransfer baffle being charged to a potential approximately the same as the charged retaining member and having said first polarity, the pretransfer baffle and the charge retaining member forming a gap for the passage of copy sheets to the transfer region, and the copy sheet being in contact with the charge retaining member before reaching the transfer region.

U.S. Pat. No. 4,739,362 discloses an improved transfer station baffled arrangement provided with first and second baffles, the first baffle provided with a curved sheet supporting surface imparting a blow to sheets passing thereby, the second baffle normally biasing the sheets against the first baffle, and biasable out of position with respect thereto. A flexible lip may be provided on the second baffle to absorb spring force energy in sheets passing through the baffle spring force energy in sheets passing through the baffle spring force energy in sheets passing through the baffle arrangement as the direction of sheet travel is changed.

The 5775 Principles of Operation Manual discloses a pair of baffle fingers for directing a sheet into a gripper bar. (See also Prior Art FIG. 3C). The baffle fingers are used to intermittently contact the sheet so as to move its lead edge towards the jaws of a recirculating sheet gripper, as shown on page 8–29.

In accordance with one aspect of the present invention, there is provided an apparatus for advancing a sheet in a predetermined path, including a gripper for releasably grasping a lead edge of the sheet and a baffle for feeding the sheet into the gripper. The baffle includes a sheet directing member having a first facet and a second facet, with the second facet of the sheet directing member extending from the first facet and being angled towards the predetermined path of the sheet for deflecting the lead edge of the sheet being advanced into the gripper.

In accordance with another aspect of the present invention, there is provided printing machine having an apparatus for advancing a sheet in a predetermined path, including a gripper for releasably grasping a lead edge of the sheet and a baffle for feeding the sheet into the gripper. The baffle includes a sheet directing member having a first facet and a second facet, with the second facet of the sheet directing member extending from the first facet and being angled towards the predetermined path of the sheet for deflecting the lead edge of the sheet being advanced into the gripper.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 5:
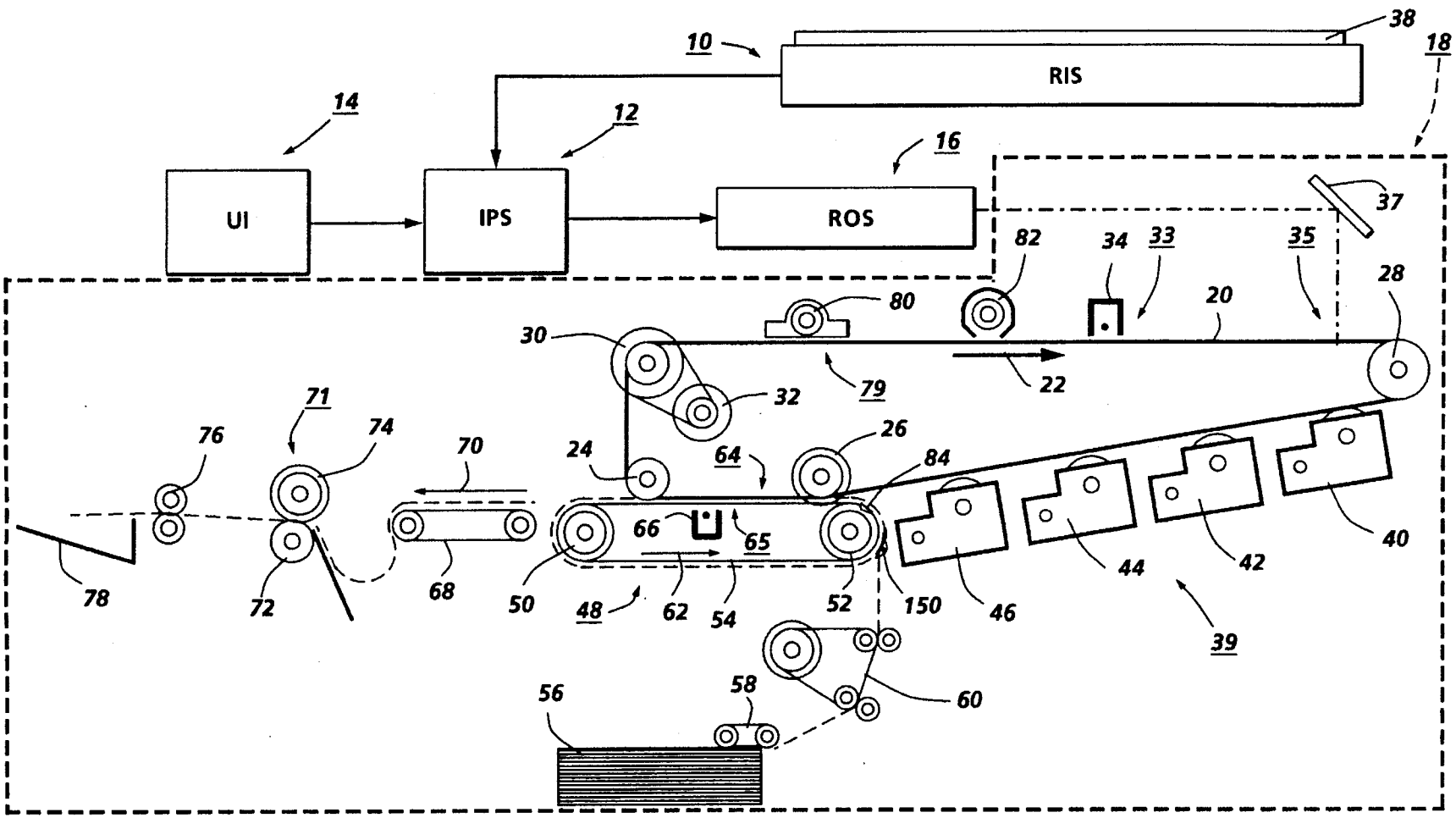
FIG. 5 is a schematic elevational view showing an electrophotographic printing machine incorporating the features of the present invention.

For a general understanding of the features of the present invention, reference is made to the drawings. In the drawings, like references have been used throughout to designate identical elements. FIG. 5 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 5, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 5, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. The modulated light beam impinges on the surface of photoconductive belt 20. The beam illuminates the charged portion of photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is positioned substantially adjacent the photoconductive belt, while in the non-operative position, the magnetic brush is spaced therefrom. In FIG. 5, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (see FIGS. 2 and 4) extends between belts 54 and moves in unison therewith. A sheet 25 (see FIG. 2) is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multi-color copy of the colored original document.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 1:
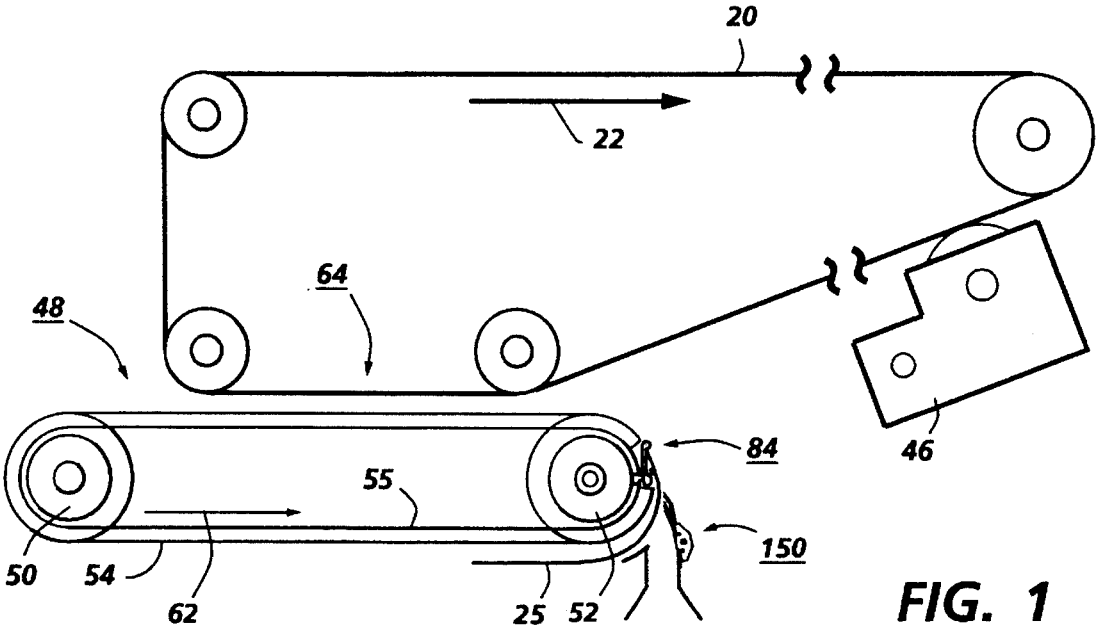
FIG. 1 is a schematic elevational view showing a sheet transport system incorporating the features of the present invention therein.
Figure 2:
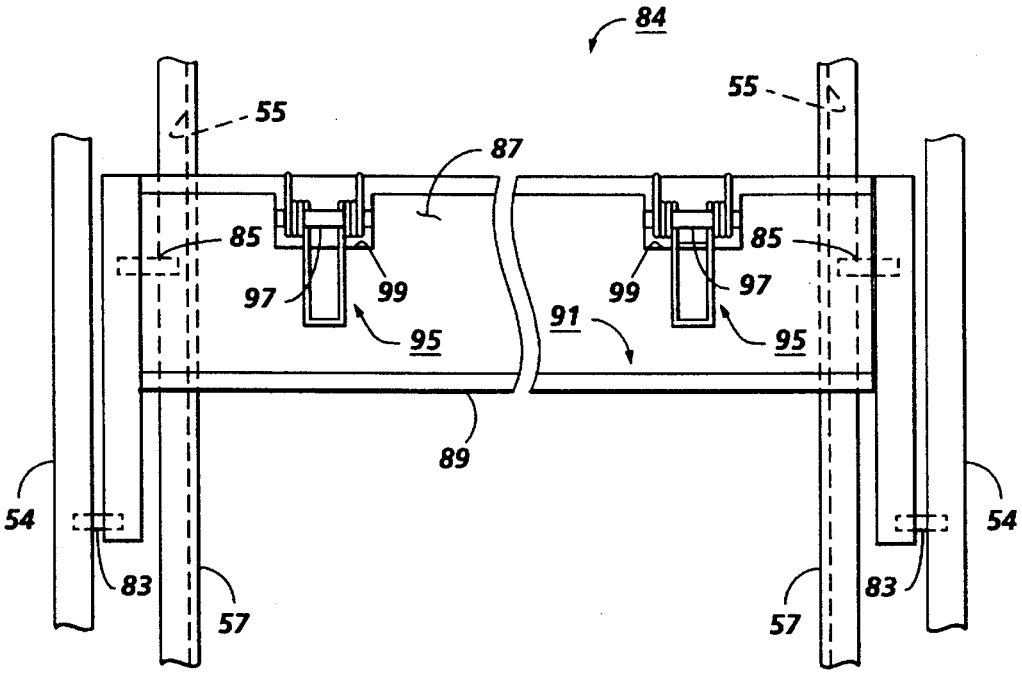
FIG. 2 is a schematic planar view showing the sheet gripper of the sheet transport system used in the sheet transport system of FIG. 1.

FIG. 1 shows sheet gripper 84 of sheet transport 48 transporting sheet 25 in the direction of arrow 62 in a recirculating path of movement. FIG. 2 shows sheet gripper 84 suspended between two spaced apart timing belts 54. Referring to FIGS. 1 and 2, timing belts 54 are entrained about rollers 50 and 52. Belts 54 define a continuous path of movement of sheet gripper 84. A motor (not shown) is coupled to roller 52 by a drive belt. Sheet gripper 84 includes a pair of guide members 85. A pair of spaced apart and continuous tracks 55 are respectively positioned substantially adjacent belts 54. Tracks 55 are respectively defined by a pair of track supports 57. Each of guide members 85 are slidably positioned within a respective track 55. Sheet gripper 84 further includes an upper sheet gripping portion 87 and a lower sheet gripping portion 89 which are biased toward each other by a plurality of springs, each being generally indicated by the reference numeral 95 as shown in FIG. 2. A plurality of securing pins 97 are respectively positioned within a plurality of apertures 99 of upper gripping portion 87 and secured thereto to hold springs 95 in place so as to bias upper gripping portion 87 toward lower gripping portion 89.

The sheet gripper further includes a pair of cam followers 100 (further detailed in FIGS. 4A and 4B) which are attached to the opposed side marginal regions of upper gripping portion 87 and function with a pair of cam arms to displace upper gripping portion 87 relative to lower gripping portion 89 to open and close the sheet gripper at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIG. 2). A silicone rubber coating (not shown) may be positioned upon lower sheet gripping portion 89, near a sheet gripping nip, in order to increase the frictional grip of sheet 25 between the gripping portions. Belts 54 are respectively connected to the opposed side marginal regions of sheet gripper 84 by a pair of pins 83 as shown in FIG. 2. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

Figure 4A:
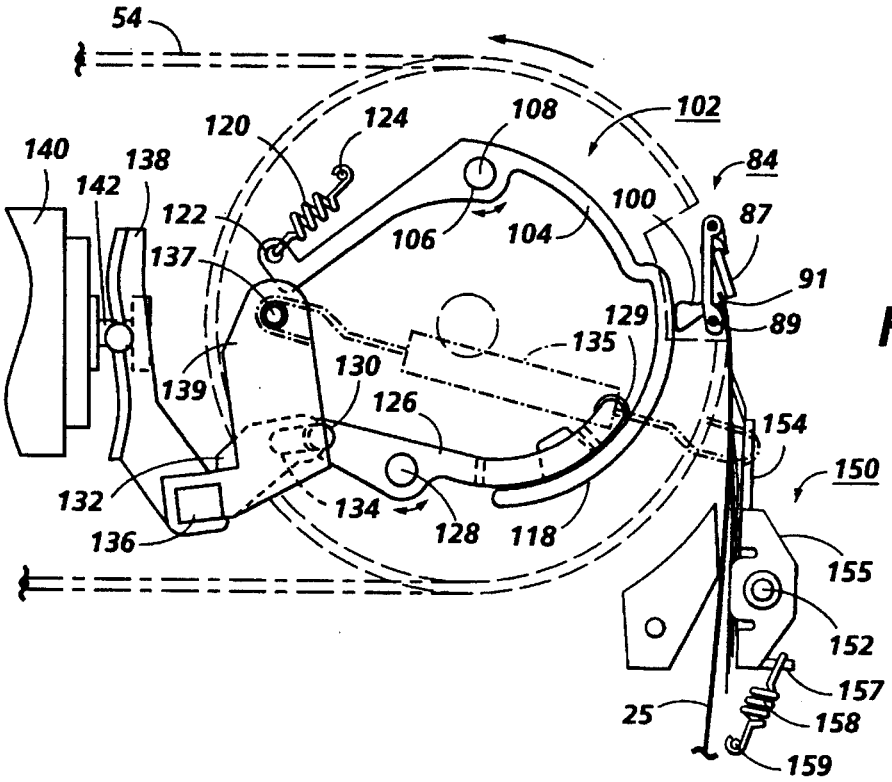
FIG. 4A is a sectional elevational view of the sheet baffle and gripper system of the present invention in contact with a sheet.

The sheet control baffle 150 of the present invention controls the movement of the sheet while it is being advanced in its path within printer 18. It will be understood that this baffle is employed (as shown in FIG. 4A) to affect and control movement of the sheet when it is being initially fed into the nip of sheet gripper 84 as shown in FIG. 2.

Figure 3A:
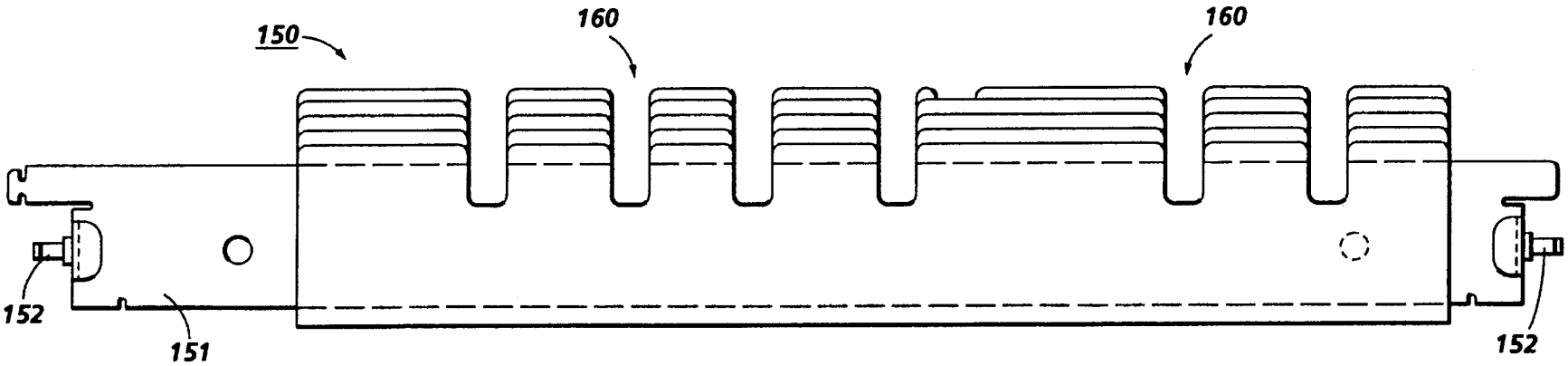
FIG. 3A is an elevational view of the sheet baffle of the present invention.

FIG. 3A shows sheet control baffle 150 of the present invention. A rigid support plate 151 provides the mounting surface for baffle members 153 and 156 as shown in FIG. 3B. Rigid support plate 151 is connected at each end to brackets 155 (see FIGS. 4A and 4B); pins 152 at the ends of brackets 155 permit baffle 150 to be pivoted in and out of sheet engaging position. 5beet directing members 153 and 156 (FIG. 3B) as shown in FIG. 3A include optional gaps 160, which may accommodate support ridges or other interceding members (not shown). Baffle 150 is shown having a length substantially equal to the width of sheet 25, although the fingers of baffle 150 need not be continuous in some embodiments to properly deflect sheet 25 for insertion into and proper registration by sheet gripper 84.

FIG. 3B shows sheet control baffle 150 of the present invention, with sheet directing members 153 and 156 mounted to rigid support plate 151. In the embodiment shown, baffle 150 includes three sheet directing members 153 having a single bend (and thus, a single sheet directing facet) and two sheet directing members 156 having a first and second bend (thus having two sheet directing facets). Sheet directing members 153 and 156 act independently in insuring that the leading edge of a sheet is gently yet firmly maneuvered into position in sheet gripper 84, and as shown in FIG. 3B, are mounted to support plate 151 in a cascading or staggered manner. The end facets or bent portions of each sheet directing member 153 and 156 of the present invention extend angularly towards the passing lead edge of a sheet as it travels toward sheet gripper 84 (as shown in FIG. 4A), thus providing the requisite levels or "layers" of pressure required to contact and then direct even stiff, uneven or "curled away" sheet lead edges into the sheet gripper, thus increasing copier/printer sheet gripper reliability.

For example, a stiff sheet edge or duplex color print with reverse (away from the gripper/sheet path) curl might not be directed by prior art baffles into sheet gripper 84, potentially resulting in a sheet jam or misfeed. With the baffle of the present invention, even stiff or highly reverse-curled sheets are less likely to fail to be properly deflected by one (or up to five or more) of the sheet directing members 153 and 156 of the present invention into the sheet gripper. For example, in the case of a less rigid or flexible sheet, only one or two baffle sheet directing member(s) 153 might be required or utilized (contacted by the lead edge of the sheet) to direct that lead edge into the sheet gripper; the sheet may even contact the first facet and then second facet of the first (upstream) sheet directing members 153, and by it alone be directed into the jaws of the sheet gripper. In the case of a curled or stiff sheet, each sheet directing member 153 and one to three (or more) sheet directing members 156 might be required or utilized (contacted by the lead edge of the sheet) to direct that lead edge into the sheet gripper. The distinctively angled facets or bent ends of the sheet directing members of the present invention apply only enough pressure on the sheet required to press it towards and into the sheet gripper, thus reducing the likelihood that the edge of the sheet will "stub" on the gripper, sheet guide or other obstruction, if not the baffle itself (and subsequently jam or misregister in the sheet gripper).

While two or more sheet directing members may be desired in certain embodiments, a single bent (multifaceted) baffle member, such as a sheet directing member 153 or 156 described above, can result in the improved sheet directing reliability of the baffle of the present invention. The baffle members are preferably of a somewhat flexible (or semi-rigid) sheet material, such as plastic, nylon, silicon, metal or aluminum sheet material. The lead edge of the sheet being controlled preferably slides easily off of each friction inhibited facet of each baffle member; each facet surfaces of the baffle members thus resist sheet edge stubbing or other resistance to sheet edge passage other than gentile edge directing contact. The first facet of a sheet baffle member can apply greater force as required to deflect a sheet edge in a desired path; as each subsequent angled facet (after each bend) contacts the lead edge of the sheet, that facet may deflect more (applying gentler pressure), while in When Sheet control baffles are employed with multiple baffle members (such as shown in FIG. 3B), each staggered baffle member may be heat sealed, glued, tacked or otherwise affixed to the underlying baffle member, with the final underlying baffle member being similarly affixed to support plate 151. This "layered" use of multiple baffle members can permit sheet directing members of only one or two types (such as 153 and/or 156) to be used in staggered fashion in a sheet control baffle 150.

Figure 3C:
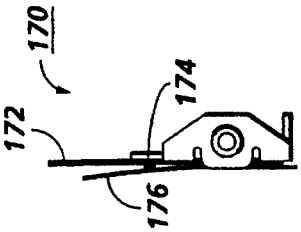
FIG. 3C PRIOR ART
FIG. 3C is a side view of a prior art sheet baffle.
Figure 3B:
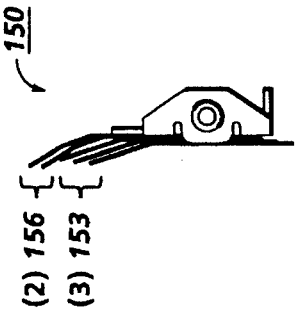
FIG. 3B is a side view of the sheet baffle shown in FIG. 3A.

Prior art baffles such as the baffle 170 shown in FIG. 3C may only have flat fingers 172 and 176 separated by a spacer 174 can lead to misfeeds, in which a sheet is not properly acquired by the sheet gripper. This or other systems may employ flat or curved fingers that do not perform according to the multifaceted sheet directing members taught by the present invention.

As shown in FIG. 4A, upper sheet gripping portion 87 and lower sheet gripping portion 89 of sheet gripper 84 cooperate to grasp sheet 25. Upper sheet gripping portion 87 and lower sheet gripping portion 89 are biased toward each other by a plurality of springs. The sheet gripper further includes a pair of cam followers 100 which are attached to the opposed side marginal regions of upper gripping portion 87 and function with a pair of cam arms to displace upper gripping portion 87 relative to lower gripping portion 89 to open sheet gripper to accept sheet 25. Cam arms 100 thereafter release upper gripping portion 87 so as to grip sheet 25; in the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91. The portion of sheet transport system 48 shown in FIG. 4A includes a pair of cam mechanisms, generally indicated by the reference numeral 102. Since cam mechanisms 102 are substantially similar in structure and moreover function substantially the same, only one of the cam mechanisms is shown in FIG. 4A and described in detail. Cam mechanism 102 includes cam arm 104, a cam pivot hole 106 and a cam pivot pin 108. Cam arm 104 is pivots about cam pivot pin 108. Outer cam profile 118 is defined the outer surface of cam arm 104. Cam link arm 126 moves about fixed pivot pin 128; a roller 129 at one end of cam link arm 126 contacts an inner surface of cam arm 104, causing sheet gripper 84 to remain in the open position as shown in FIG. 4A. The opposite end of cam link arm 126 includes a pin 130, slidably positioned in slot 134 of positioning arm 132. Positioning arm 132 is fixed to shaft 136; as solenoid shaft 142 retracts into solenoid 140, solenoid arm 138 rotates shaft 136. When solenoid 140 is in one mode of operation (FIG. 4A), shaft 142 of solenoid 140 is positioned so as to maintain cam arm 104, via cam link arm 126, in contact with cam follower 100 of sheet gripper 84. Consequently, upper gripping portion 87 is displaced relative to lower sheet gripping portion 89 against the bias of springs 95 as sheet gripper 84 passes over cam arm 104 (see also FIG. 2). When solenoid 140 is in another mode of operation (FIG. 4B), shaft 142 of solenoid 140 is positioned so as to maintain cam arm 104, via cam link arm 126, displaced from cam follower 100 of sheet gripper 84. Consequently, upper gripping portion 87 is and lower sheet gripping portion 89 grip sheet 25 according to the bias of springs 95 of sheet gripper 84 (see also FIG. 2).

Figure 4B:
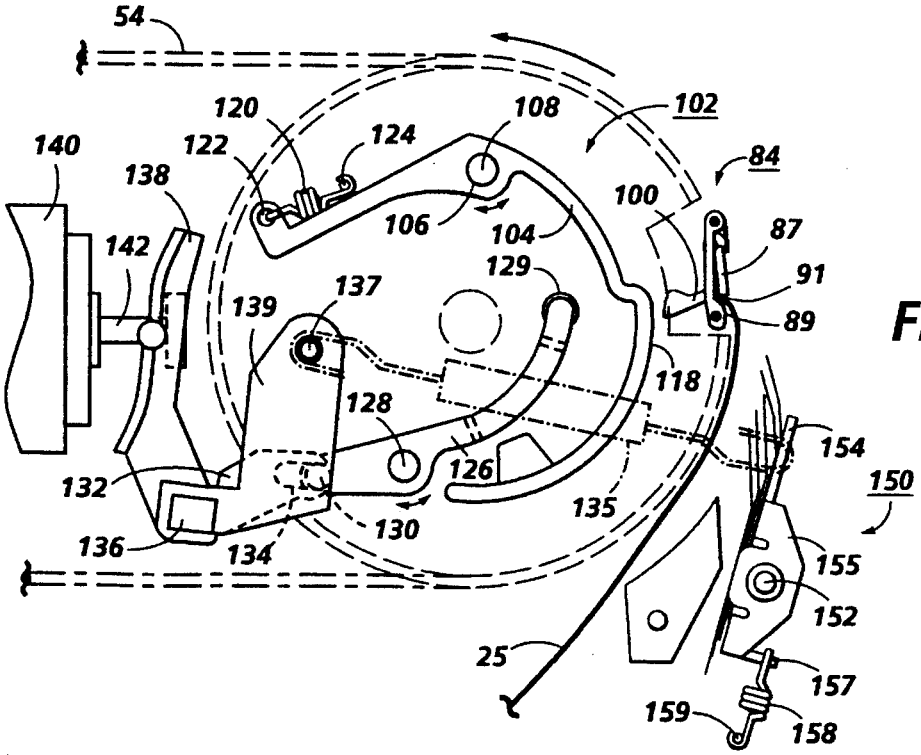
FIG. 4B is a sectional elevational view of the sheet baffle and gripper system of the present invention withdrawn from contact with a sheet.

As further shown in FIG. 4A, sheet control baffle 150 of the present invention reliably controls the positioning of the lead edge of the sheet while it is being inserted between upper sheet gripping portion 87 and lower sheet gripping portion 89 of sheet gripper 84. Baffle 150 has a length substantially equal to the width of sheet 25. In particular, baffle 150 includes a pair of brackets 155 pivotally mounted to a pin 152. Baffle 150 is pivotable between a closed position (when gripper 84 is proximate and open to accept sheet 25, as shown in FIG. 4A) and an open or displaced position (when gripper 84 is closed on sheet 25, as shown in FIG. 4B). Spring 158 is connected to a fixed pin 159 and to a lower portion 157 of baffle 150 so as to bias baffle 150 away from drum 50 and sheet 25. As solenoid 140 pulls shaft 142 as shown in FIG. 4A, solenoid arm 138 rotates shaft 136; baffle arm 139 thereby tensions baffle link spring 135 connected at one end to pin 137 of baffle arm 139, and at the other end to baffle lever 154 of baffle 150. Again, FIG. 4A shows cam arm 104 positioned so as to open sheet gripper 84; at the same time solenoid 140 moves cam 104 arm to open sheet gripper 84 to accept sheet 25, the bias of spring 158 on baffle 150 is overcome by solenoid 140 as described above so as to so as to pivot baffle 150 towards drum 50 so as to insure sheet 25 is properly fed or deflected into sheet gripper 84. As shown in FIG. 4B, once sheet 25 has been properly fed into sheet gripper 84, according to the linkage described above, baffle 150 is released, so as to retract into inoperative position according to the bias of spring 158 on lower portion 157 of baffle 150.

While the present invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for advancing a sheet in a predetermined path, comprising:

a gripper releasably grasping a lead edge of the sheet;

a curved surface located adjacent the predetermined path, the gripper initially grasping the lead edge of the sheet along the curved surface;

a baffle for feeding the sheet into the gripper, said baffle including a plurality of sheet directing members, each sheet directing member having a first facet and a second facet, said second facet of the sheet directing members extending from said first facet for deflecting the lead edge of the sheet being advanced into said gripper, wherein said plurality of sheet directing members are closely spaced and span a large enough area so that the lead edge of the sheet is directed along the predetermined path;

at least one of said plurality of sheet directing members further comprises a third facet for further deflecting the lead edge of the sheet; and the sheet initially comes into contact with a two faceted sheet directing member and finally a three faceted sheet directing member as the sheet is advanced into said gripper.

2. The apparatus of claim 1, wherein the two faceted sheet directing members and said three faceted sheet directing members are staggered so that the optimal amount of pressure is exerted by each sheet directing member on the lead edge of the sheet.

3. The apparatus of claim 1, wherein at least one of said plurality of sheet directing members exerts a force on the lead edge of the sheet spaced from the curved surface as the lead edge of the sheet is advanced into said gripper.

4. The apparatus of claim 3, wherein a majority of said plurality of sheet directing members exerts forces on the lead edge of the sheet spaced from said curved surface as the lead edge of the sheet is advanced into said gripper.

5. An apparatus for advancing a sheet in a predetermined path, comprising:

a gripper releasably grasping a lead edge of the sheet;

a curved surface located adjacent the predetermined path, the gripper initially grasping the lead edge of the sheet along the curved surface; and a plurality of sheet directing members located on one side of the sheet which substantially span an entire length of the edge of the sheet, each sheet directing member for deflecting the lead edge of the sheet being advanced into said gripper;

wherein said plurality of sheet directing members are staggered over a sufficient distance so that the lead edge of the sheet is directed along the predetermined path.

6. The apparatus of claim 5, wherein the plurality of sheet directing members are located in close proximity to one another so that the force exerted by the lead edge of the sheet is distributed over the plurality of sheet directing members, prior to the sheet coming into contact with the curved surface.

7. The apparatus of claim 5 wherein a majority of the plurality of sheet directing members exert forces on the lead edge of the sheet spaced from the curved surface.

8. An apparatus as claimed in claim 5, wherein there are more than two sheet directing members.

9. An apparatus as claimed in claim 5, wherein the sheet directing members deflect the lead edge of the sheet towards the curved surface.

10. The apparatus as claimed in claim 5, wherein at least one of the sheet directing members is spaced from the curved surface so that it does not exert a force directly on the curved surface and causes the lead edge of the sheet to be directed along the predetermined path.

11. An apparatus for advancing a sheet in a predetermined path, comprising:

a gripper releasably grasping a lead edge of the sheet;

a curved surface located adjacent the predetermined path, the gripper initially grasping the lead edge of the sheet along the curved surface;

a baffle for feeding the sheet into the gripper, said baffle including more than two sheet directing members which are located on one side of the sheet, each sheet directing member having a first facet and a second facet, said second facet of the sheet directing members extending from said first facet for deflecting the lead edge of the sheet being advanced into said gripper, wherein said plurality of sheet directing members are closely spaced and span a large enough area so that the lead edge of the sheet is directed along the predetermined path; and at least one of the sheet directing members is spaced from the curved surface so that it does not exert a force directly on the curved surface, causing the lead edge of the sheet to be directed along the predetermined path.

12. The apparatus as claimed in claim 11, wherein the apparatus is used in a printing machine.

13. An apparatus as claimed in claim 11, wherein there are more than two sheet directing members.

14. An apparatus as claimed in claim 11, wherein the sheet directing members deflect the lead edge of the sheet towards the curved surface.

15. The apparatus as claimed in claim 11, further comprising a plurality of three faceted sheet directing members mounted adjacent to the predetermined path of the sheet for feeding the sheet into the gripper, wherein each facet of each three faceted sheet directing member is graduatingly angled towards said predetermined path for deflecting the lead edge of the sheet being advanced into said gripper.

* * * * *